United States Patent [19]

Johnston

[11] Patent Number: 4,875,316

[45] Date of Patent: Oct. 24, 1989

[54] COMBINATION METAL AND WOOD WINDOW FRAME ASSEMBLY

[76] Inventor: Bernard A. Johnston, 3026 Fairfield Ave., Downers Grove, Ill. 60515

[21] Appl. No.: 31,527

[22] Filed: Mar. 27, 1987

[51] Int. Cl.[4] ..... E06B 1/04

[52] U.S. Cl. ..... 52/204; 52/207

[58] Field of Search ..... 52/204, 207, 211; 49/DIG. 1, DIG. 2

[56] References Cited

U.S. PATENT DOCUMENTS

| | | | |
|---|---|---|---|
| 3,093,217 | 6/1963 | Doede | 189/34 |
| 3,402,510 | 9/1968 | Johnson | 49/414 |
| 3,780,473 | 12/1973 | Kort et al. | 49/DIG. 1 |
| 3,815,285 | 6/1974 | Kuyper | 49/501 |
| 3,832,818 | 9/1974 | Nahr | 52/731 |
| 4,122,633 | 10/1978 | Holdiman | 49/501 |
| 4,207,707 | 6/1980 | Holdiman et al. | 49/501 |
| 4,219,983 | 9/1980 | Kern et al. | 52/730 |
| 4,222,200 | 9/1980 | Beirnes | 49/63 |
| 4,344,254 | 8/1982 | Varlonga | 49/401 |
| 4,420,919 | 12/1983 | Weber | 52/204 |
| 4,432,179 | 2/1984 | Bachmann | 52/396 |
| 4,447,985 | 5/1984 | Weber et al. | 49/DIG. 1 |
| 4,483,099 | 11/1984 | Schmidt | 49/63 |
| 4,495,726 | 1/1985 | Lindstrom | 49/401 |
| 4,524,112 | 6/1985 | Willert | 428/595 |
| 4,558,536 | 12/1985 | Dunsmoor | 49/404 |
| 4,569,170 | 2/1986 | Gartner | 52/204 |

FOREIGN PATENT DOCUMENTS

| | | | |
|---|---|---|---|
| 0053104 | 6/1982 | European Pat. Off. | 52/204 |
| 2524539 | 10/1983 | France | 52/204 |

OTHER PUBLICATIONS

Windowoods by Wausau commercial brochure, Wausau Metals Corporation, Wausau, Wis.–undated.

The Pella Clad Monumental Window Series commercial brochure, by Rolscreen Company, Pella, Iowa, bearing copyright date 1983.

*Primary Examiner*—David A. Scherbel

*Assistant Examiner*—Creighton Smith

[57] ABSTRACT

An improved metal and wood window frame assembly is disclosed in which the combination wood and metal window frame assembly has relatively thick wood frame members facing the interior of the building which are mechanically joined to the metal primary window frame by tight, deep-keyed interconnections. The primay metal frame comprises two separate metal frame members which are rigidly connected by a thermal break insulator. The wooden glazing bead members, due to their deep-keyed interconnection to the metal frame, provide rigid glass stops for the glass pane assembly. The thick wood frame members provide significantly improved sound transmission, thermal quality and rigidity properties to the combination window frame assembly made according to the present invention.

6 Claims, 3 Drawing Sheets

FIG. 1
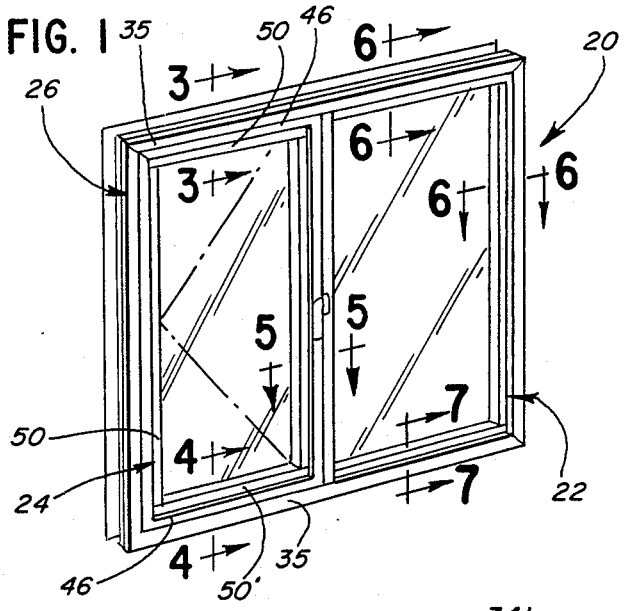
FIG. 2
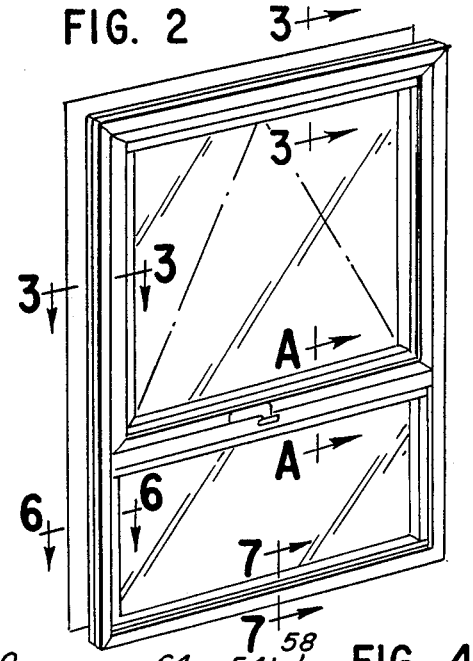
FIG. 3
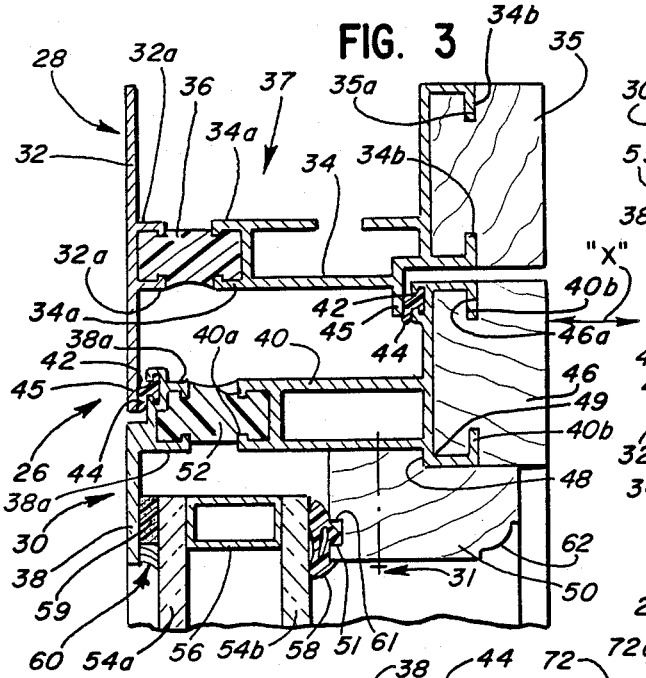
FIG. 4
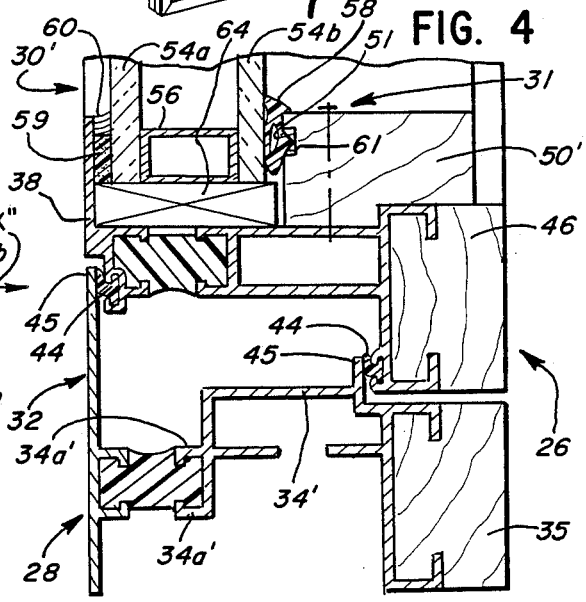
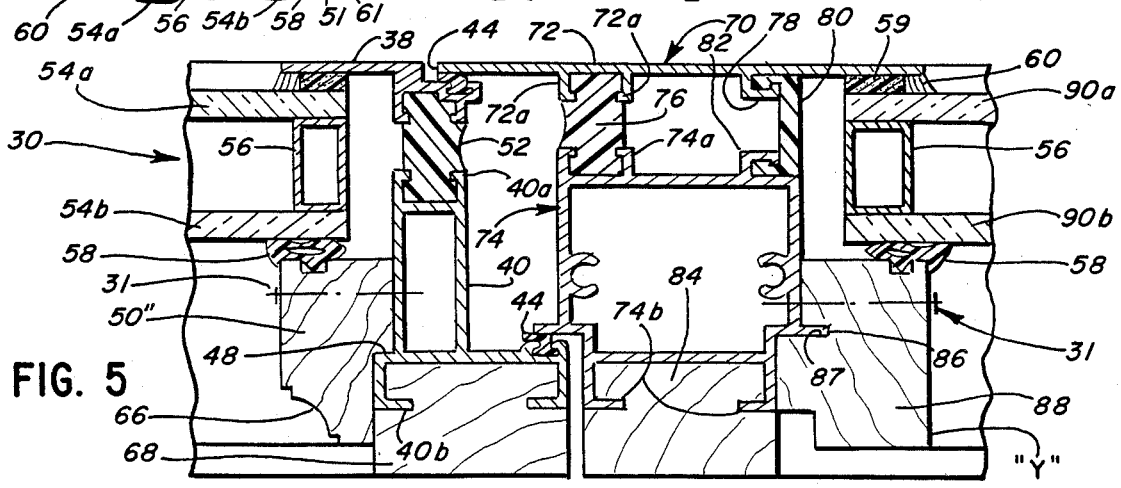
FIG. 5

COMBINATION METAL AND WOOD WINDOW FRAME ASSEMBLY

FIELD OF THE INVENTION

This invention relates to window frame apparatus and more particularly to combination window frame assemblies made of both wooden and metal frame components.

BACKGROUND OF THE INVENTION

There have been numerous prior attempts to make combination wood and metal window frame assemblies for purposes of both thermal insulation as well as to enhance the interior aesthetics of a metal window frame.

In one such attempt an essentially all wood window frame has a thin metal veneer or cladding applied to it. In another version, an otherwise all metal window frame has thin wood cladding applied to the visible interior surfaces of the window frame to enhance the overall appearance of the metal window. Typically, such wood and metal frame members are joined by adhesives or by a minimal mechanical connection, such as a slight kerf by which a thin metal cladding is snap-fitted to a wooden window frame rail or stile. Adhesives are disadvantageous in that they can eventually dry out and allow parts to fall apart, while minimal snap-fitting can also permit parts to become separated.

The present invention overcomes the disadvantages of the prior art by providing a so-called high performance commercial grade window able to resist heavy positive and negative wind pressure by providing a combination wood and metal window frame assembly. The primary structural frame of the present window frame assembly is made of metal and has on its interior surface relatively thick wood frame members which are mechanically interconnected thereto. Because the substantial wood frame members are mechanically deep-keyed to the metal frame, the wood frame members cannot be readily disjoined from the metal window frame components. Further, wood glazing strips deep-keyed over an aluminum frame extension act as rigid glass stops against wind pressure. That is, the wood glazing members directly hold the glass pane assembly against the metal frame and operate to resist heavy wind pressure on the glass pane assembly.

Thus, it is a primary object of the present invention to provide a rigid combination metal and wood window frame assembly in which relatively thick wood members are deeply and tightly keyed, i.e., rigidly mechanically interconnected, to the interior surface of the primary metal window frame.

It is a further object of the present invention to provide a combination metal and wood window frame assembly in which the wood glazing members, due to their tight-keyed connection to the primary metal window frame, can act as a rigid glass stop by bearing directly against the glass pane assembly.

It is yet a further object to provide a combination metal and wood window frame assembly in which the wood frame members are substantially thick so as to reduce both sound and thermal transmission and to substantially improve the rigidity of the overall window.

It is a still further object to provide a specially-configured continuous retainer member means, surround member means, and panning member means to help affix and position the present improved combination metal and wood window frame assembly during its installation in an existing window opening.

The means by which the foregoing and other objects of the present invention are accomplished and the manner of their accomplishment will be readily understood from the following specification upon reference to the accompanying drawings, in which:

FIG. 1 is a perspective view of a so-called "side-by-side" vent/fixed window utilizing the combination wood and metal window frame assembly of the present invention;

FIG. 2 is a perspective view of a so-called "over and under" top-hinged-over-fixed window utilizing the present invention;

FIG. 3 is a section view of the window frame of the present invention taken along lines 3—3 of either FIG. 1 or FIG. 2;

FIG. 4 is a section view taken along lines 4—4 of FIG. 1;

FIG. 5 is a section view taken along lines 5—5 of FIG. 1 (FIG. 5 could also represent a section view taken along lines A—A of FIG. 2, but in that case the drawing view of FIG. 5 would be oriented horizontally rather than vertically as is shown in FIG. 5);

DESCRIPTION OF THE PREFERRED EMBODIMENT

Figure 6:
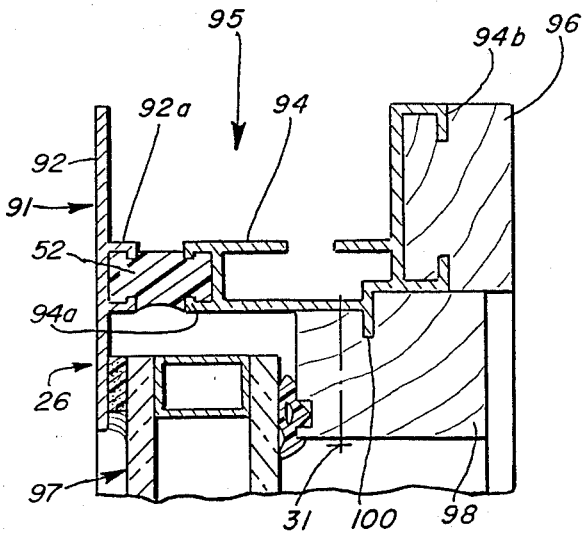
FIG. 6 is a section view taken along lines 6—6 of either FIG. 1 or FIG. 2 (but similarly subject to the alternate orientation change as noted above as to FIG. 5, depending upon the view taken)

Having reference to the drawings, wherein like reference numerals indicate corresponding elements, there is shown in FIG. 1 an illustration of a so-called side-by-side vent/fixed window utilizing the improved window frame construction of the present invention, which window is generally denoted by reference numeral 20. The right-hand section 22 of window 20 is fixed, whereas the left-hand or ventilator section 24 is of the casement type, i.e., it is movable to a building's interior about hinges (not shown) and hinged about the left vertical side thereof. The window 20 has an overall composite frame assembly 26 which includes various individual components, some made of semi-tubular metal sections and others made of wood.

With respect to the ventilator section 24 in FIG. 1, the upper horizontal and left vertical portions of frame assembly 26 are best seen in section in FIG. 3. In that FIGURE, the composite frame assembly 26 includes an outer fixed window frame assembly 28 and an inner removable ventilator frame assembly 30. The outer window frame assembly 28 includes a first or external frame element 32 and a second or internal fixed frame element 34. Both frame elements 32,34 are the primary frame members for the fixed window frame assembly 28 and are preferably metal and formed as extruded aluminum members. The fixed frame elements 32 and 34 are rigidly held together, i.e., integrally joined, by a thermal bridge insulating member 36, such as formed of poured polyurethane, for example. The thermal bridge member 36 is held in place by pairs of protruding tabs 32*a*,32*a* and 34*a*,34*a*.

The internal fixed frame element 34 is specially configured at its end opposite the tabs 34*a* to have elongated C-shaped gripper ear members 34*b*. These gripper members 34*b* are used to securely retain a wooden frame member 35 (discussed below) to the internal metal frame element 34 such that the wood frame member extends towards the interior of the building. In a well known fashion, a U-shaped opening, generally denoted by reference numeral 37, as formed by metal frame elements 32 and 34, can be used to receive a structural building element, such as a wall framing stud, in a window opening of a building (neither shown) thereby to position the window 20 of the present invention. The opening 37 can also be used to receive specially configured retainer clip means, as described later herein in connection with FIG. 9.

The removable ventilator frame portion 30 of composite window frame assembly 26 is comprised of an outer metal frame element 38 and a metal inner frame element 40. The inner frame element 40 has a weatherstripping groove 42 for retaining a flexible weatherstrip 44. The frame element 40 also has a bead retainer ledge 48 formed thereon for purposes of receiving a correspondingly-shaped, undercut edge 49 of an interior glazing bead or glass stop frame member 50 which is formed of wood. A glazing bead fastener 31 is used to secure the wood glass stop member 50 to the metal inner frame element 40, once the undercut edge 49 has been firmly seated against the ledge 48.

The inner frame element 40 also includes a pair of C-shaped gripper ear members 40*b*,40*b* for rigidly retaining a relatively thick interior wood frame member 46 thereto. Another relatively thick, interior wood frame member 35 is mechanically held in like fashion to internal fixed frame member 34 by the use of gripper tabs 34*b*,34*b*. It will be understood that the pairs of slots or recesses 35*a*,46*a* respectively cut in wood frame elements 35, 46, as used to respectively accommodate the gripper ear members 34*b*,40*b*, are only of a width sufficient enough to tightly receive such gripper ear members. That is, the rigid mechanical interconnection of the relatively thick interior wood frame elements with the corresponding metal frame gripper members is a tightly and deeply keyed fit rather than a loose connection.

It will be seen in FIG. 3 that when the removable ventilator frame assembly 30 is closed and locked (see directional line of movement labelled "X") against the fixed frame assembly 28, the respective flexible weatherstrip beads 44 carried on frame assembly 30 operate to tightly engage against the frame lip extensions 45 (which are respectively formed on the first and second fixed frame elements 32, 34). These flexible weatherstrips 44 provide the desired air lock between the respective fixed and movable frame assemblies 28, 30.

The movable frame elements 38 and 40 are also integrally connected by a thermal bridge element 52 which is rigidly held in place by pairs of C-shaped retaining ears 38*a*,40*a*. A pair of planar glass panes 54*a*,54*b* are separated by a hollow separator member 56, which is also preferably made of aluminum. The glass panes 54*a*,54*b* are rigidly held in position—relative to movable frame assembly 30—between the metal frame element 38 and the wooden glass stop 50. A flexible, so-called vision strip 58 (preferably made of a suitable soft rubber compound) separates the glass pane 54*b* from wooden glass stop 50, while a compressible sponge glazing tape member 59 and an exterior glazing cap bead 60 separate the glass pane 54*a* from the outer metal frame element 38. In this manner, the wooden glass stop member 50, firmly positionally keyed as it is to retainer ledge 48 on inner metal frame element 40 and secured by fastener 31, operates to directly pressibly force together the combination of glass panes 54*a*,54*b*, separator 56, vision strip 58, glazing tape 59 and exterior glazing cap bead 60, against outer metal frame element 38.

The wooden glass stop 50 preferably has a channel 51 formed in the rear edge thereof for retainably accepting a retainer nib 61 formed on the vision strip 58. The engagement of nib 61 in channel 51 causes the vision strip 58 to be firmly held in place between glass stop 50 and glass pane 54*b* once inserted therein during assembly of the window 20. Also, in the preferred embodiment (see FIG. 3), the wooden glass stop 50 has a routed corner 62 which provides a pleasing appearance to the interior of the removable ventilator frame 30.

The window frame section depicted in FIG. 4 is substantially similar in configuration (although necessarily depicted in inverted fashion) to the frame depicted in FIG. 3. This FIG. 4 section view represents the various frame elements (fixed and movable) of the present invention as they appear in the lower horizontal section (designated by reference numeral 30') of the ventilator frame assembly 30 of the composite frame assembly 26. However, in addition to the components shown in FIG. 3, there is a so-called glass setting block 64 used under the assembly of the glass panes 54*a*,54*b* and separator 56 in FIG. 4. The setting block 64 is used to prevent that assembly of panes and separator from dropping down within the retaining channel formed by outer frame member 38 and wooden glass stop 50'. The glass setting block 64 is preferably formed of a suitable hard rubber material. It will be noted that glass stop 50' (in FIG. 4) differs from wooden glass stop 50 (of FIG. 3) only in that stop 50' preferably does not include the routed corner 62. Further, in contrast to tabs 34*a* in FIG. 3, the inner metal fixed frame element 34' in FIG. 4 is configured such that the pair of gripper tabs 34*a*' are formed offset somewhat from the remainder of frame element 34'.

It will be understood that the exterior surface of the metal frame members, such as outer frame elements 32, 38, are preferably painted, so as to match the exterior of the building to which the window frame assembly of the present invention is installed. Similarly, the interior wooden frame members, such as wooden frame members 35, 46 and glass stops 50,50', are preferably made from any suitable hardwood, such as oak, mahogony, or walnut, for example, and their exposed surfaces are pre-finished with a suitable stain and varnish top coating, as desired.

In FIG. 5 there is shown the various centrally positioned vertical frame members utilized with the combination metal and wood window frame assembly 26 of the present invention where the movable ventilator section 24 abuts the fixed section 22. It will be seen that, similar to FIGS. 3 and 4, the left portion of FIG. 5 comprises the above-described removable ventilator frame assembly 30. It includes the outer metal frame element 38, glass panes 54*a*,54*b*, the separator 56, a vision strip 58, and a wooden glass stop member 50" having a routed edge 66 (which edge design differs slightly from routed edge 62 on glass stop 50 in FIG. 3).

The glass stop 50" is again forcibly positioned against the bead retainer ledge 48 of inner metal frame element 40, and once so positioned a fastener 31 secures the glass stop 50" to inner metal frame element 40. A vertical wooden stile member 68, similar in function and shape to wooden rail members 35 and 46 in FIG. 3, is mechanically joined via deep-keying to the inner metal frame element 40 by the gripper ears **40*b*. The vertically-aligned center fixed frame assembly, generally noted by reference numeral 70, comprises an outer metal fixed frame member 72 and a specially configured inner fixed frame member 74. Both the fixed frame member 72 and 74** are preferably made of metal, such as extruded aluminum, for example.

The fixed frame member 72 has gripper elements **72*a* to secure one end of a thermal bridge member 76. The fixed frame member 72 also carries an elongated gripper member 78 which secures one end of a thermal retainer clip 80; the retainer clip 80** is preferably made of extruded vinyl.

The inner fixed frame member 74 includes gripper element **74*a* to secure the other end of the thermal bridge 76, as well as an elongated gripper element 82 to secure the other end of the thermal retainer clip 80. The frame element 74 also includes gripper ears 74*b* for providing the deep-keyed rigid retention of a second vertical wooden stile member 84, similar to wooden stile 68. A retainer ledge 86 extending outwardly from inner fixed frame element 74 operates to tightly receive in deep-keyed fashion a configured wooden glass stop member 88 via slot 87. As before the glass stop 88 is further secured to inner fixed metal frame 74 by a threaded fastener 31**.

The glass stop 88, as with glass stop 50" in FIG. 5, again forcibly presses the combination of a vision strip 58, glass panes **90*a*,90*b*, a separator 56, sponge glazing tape 59 and glazing caulk bead 60 against the outer metal fixed frame member 72. Thus, it will again be understood that the deep-keyed interconnection of the wooden glass stops to the primary metal frame members provides structural reinforcing for wind loading of the glass panes. If desired, the corner of the wooden glass stop 88 designated by reference letter Y can be routed in similar fashion to routed edge 66 of glass stop 50"** so as to aesthetically match the same.

FIG. 6 depicts the construction of the various frame members appearing at the top horizontal and right vertical portions of the fixed window section 22 of the improved window frame assembly 26 of the present invention (see FIG. 1), and also the left vertical frame portion of the lower fixed window section in FIG. 2. More specifically, a fixed window frame member 91 includes an outer metal fixed frame element 92 having gripper ears **92*a* for gripping one end of a thermal bridge 52, and an inner metal frame assembly 94 having gripper ears 94*a* for gripping the other end of the thermal bridge 52**.

Additionally, the inner fixed frame member 94 has gripper ears **94*b* to provide a tight and deep-keyed connection to an interior wooden frame member 96. Thus, it will be noted that the fixed metal frame elements 92, 94 are quite similar to metal frame elements 32, 34 of FIG. 3. However, the window pane assembly in FIG. 6, generally denoted by reference numeral 97, directly bears against the fixed metal frame element 92 rather than against a movable metal frame element. Additionally, not unlike interior wooden glass stop member 88 of FIG. 5, an interior wooden glass stop member 98 is deep-key connected to an extended retainer ledge 100 of inner fixed frame member 94. Thus, as will be noted in FIG. 6, the interior glass stop member 98 acts to forcibly press the window panel assembly 97 against the exterior metal fixed frame member 92**.

Figure 7:
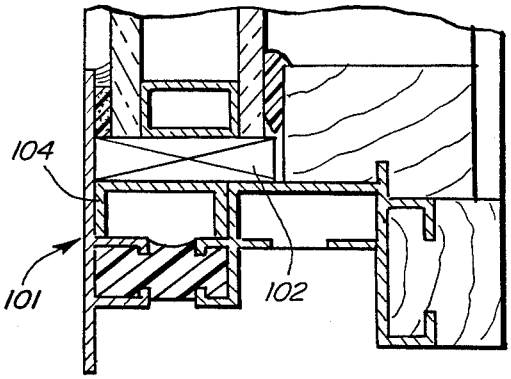
FIG. 7 is a section view taken along lines 7—7 of either FIG. 1 or FIG. 2.

In FIG. 7 there is seen in section the various frame members found at both the lower horizontal portion of the lower fixed window frame assembly of FIG. 2, and at the lower horizontal portion of right-hand fixed window section 22 in FIG. 1. In general, the configuration of the various frame members of window frame assembly 101 in FIG. 7 is similar to that of FIG. 6, but in inverted fashion. The only pertinent difference is that the frame assembly 101 includes the addition of a glass setting block 102 and a support channel 104.

Figure 8:
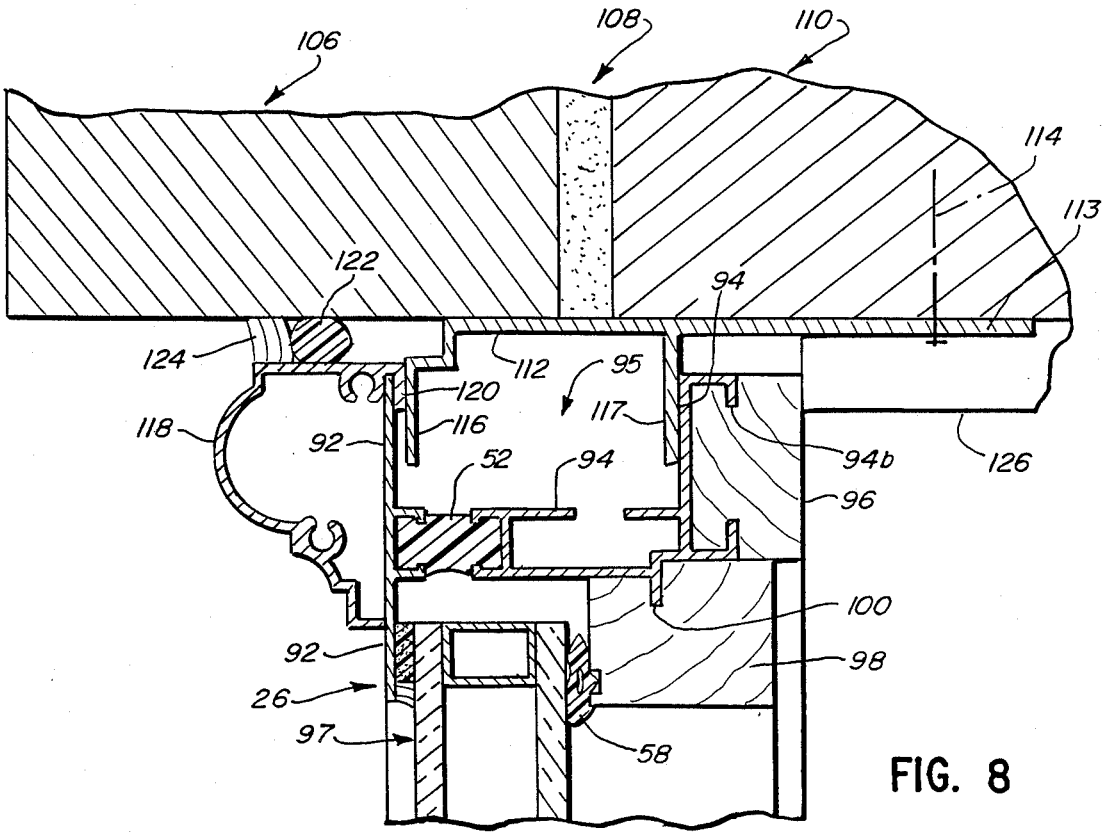
FIG. 8 is a section view, similar to FIG. 6, but showing special retainer member means and surround means for the combination window frame assembly of the present invention.

Shown in FIG. 8 is the installation of the improved combination metal and wooden window frame assembly 26 of the present invention into a window opening which is formed by building materials which do not include a suitable wooden framing member. That is, the window frame assembly 26, as shown in FIG. 6, is installed against a masonry wall consisting of exterior brick 106, mortar 108, and an interior concrete block member 110.

A so-called continuous "F" retainer clip member, preferably made of vinyl, is denoted by reference numeral 112. It preferably runs the entire length of each side of the window frame assembly 20. The stem end 113 of retainer clip 112 is fastened to the concrete block 110 by a suitable fastener member 114. The retainer wall extensions 116, 117 of the continuous-running retainer clip 112 extend away from the brick 106 and block 110 towards the window opening. That is, the wall extensions 116, 117 extend into the U-shaped channel 95 formed by the fixed metal frame members 92 and 94.

A configured decorative surround member 118 is held by a retainer lip extension 120 to the edge of outer fixed metal frame element 92. The decorative surround 118 is intended to simulate any well known wood molding shape as commonly used with windows, such as the so-called fluted bead molding shape shown in FIG. 8. A sponge glazing element 122 is jammed in between the surround 118 and the brick 106 whereupon a suitable caulk bead 124 is set in place. The installation of the window frame assembly can be completed by utilizing drywall panel 126 fitted against interior wood frame member 96.

Thus it will be seen that the retainer wall extensions 116, 117 of continuous retainer clip 112 tightly fit between the clip 120 of surround 118 and the fixed frame member 92 on the one hand, and the inner metal frame element 92 on the other hand. In this fashion, the window pane assembly 97, in fact the entire window frame assembly 26, is rigidly positioned relative to the building wall formed by brick 106 and block 110 to which the window frame assembly is being applied. Further, if the window opening is somewhat off dimensionally, i.e., it is not squarely aligned relative to the composite window frame assembly 26, or if the window opening is oversized relative to the overall dimensions of the window frame assembly 26, the continuous retainer clip 112 acts to provide additional weather protection for the installation of the window frame assembly 26. Further, the continuous retainer clip 112 allows relative adjustment during installation of a common sized window frame assembly 26 to an oversized window opening.

Figure 9:
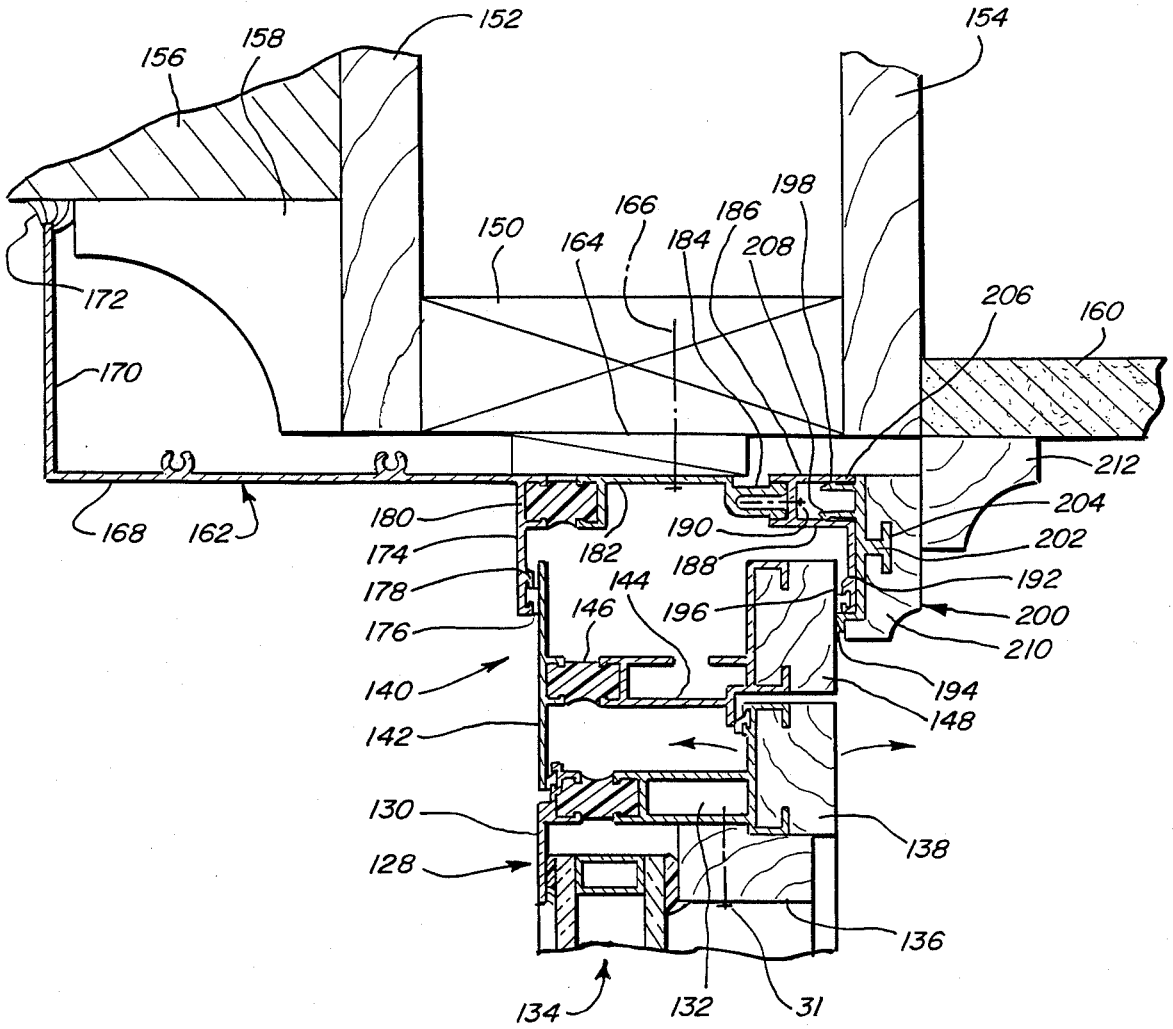
FIG. 9 is another section view, similar to FIG. 8, but showing special panning system means for use with the improved combination window frame assembly of the present invention.

There is shown in FIG. 9 a so-called panning member system usable with the combination wood and metal window frame assembly of the present invention; it is particularly advantageous for retrofit situations where old windows from an existing building are being removed and new windows made in accordance with the present invention are being installed. In FIG. 9 there is shown the present combination metal and wood window frame assembly which includes a removable ventilator window section 128 and a fixed frame section 140. The ventilator section 128 includes an outer metal frame portion 130, an inner metal frame portion 132, a glass panel assembly generally denoted by reference numeral 134, a glass stop 136, and an interior wood frame member 138. The latter is rigidly mechanically interconnected by deep-keying to the internal metal frame element 132, while the glass stop 136 is constructed similar to glass stop 50 (FIG. 3).

The fixed window frame portion 140 includes, in accordance with the above description of the present invention, an outer metal frame element 142 and a configured internal frame element 144. The metal frame elements 142 and 144 are integrally interconnected by a thermal barrier element 146. Rigidly connected by deep-keying to the internal fixed metal frame element 144 is an internal wood frame member 148.

The window opening to which the window frame assemblies 128, 140 are fitted comprises a framing stud member 150, exterior window framing member 152, interior framing member 154, exterior brick facing 156, an existing brick mold member 158, and an interior drywall panel 160. To prepare the existing window opening for a retrofitted assembly of the combination metal and wood window frame assemblies 128, 140 made in accordance with the present invention, a specially configured panning member 162 is fastened via a furring strip 164 and fastener 166 to the framing stud 150.

The panning member 162 includes an elongated central portion 168 and an exterior leg portion 170 which extends to the brick facing 156 so as to cover up the old brick molding 158. A caulk bead 172 is used to seal off the edge of the panning member 162 against the brick 156. The central portion 168 of panning member 162 has an upstanding leg portion 174 which carries a weatherstrip bead 176 in a weatherstrip groove 178. A thermal bridge member 180 rigidly connects but thermally separates the central panning portion 168 from an internal panning member 182. The innermost end of panning member 182 terminates in a U-shaped leg member 184. A specially configured structural innerlock member 186 having an H-shaped central portion 188 is fitted into and then fastened to the U-shaped leg member 184 of panning member 182 by a fastener 190. The structural innerlock 186 includes an extended leg member 192 terminating in a weatherstrip 194 which is held within a weatherstrip groove 196. Additionally, the structural innerlock 186 includes internal gripper tang elements designated generally by reference numeral 198.

As will be seen in FIG. 9, the fixed combination wood and metal frame assembly 140 is inserted between the upstanding leg member 174 of panning section 162 and the leg extension 192 of structural innerlock 198. Then, by tightening the fastener 190, the leg member 192 is tightened, i.e., moved to the left in FIG. 9 relative to the leg member 174. In this manner the fixed window frame assembly 140 is rigidly held in place within the window opening to which it is being retrofitted.

To complete the retrofit installation of the window frame assemblies 128, 140 to the existing window opening (FIG. 9), a specially configured combination metal and wood closure piece 200 is used. The closure piece 200 includes a metal element 202 including an upstanding T-shaped key section 204 and a pair of outwardly extending leg members 206. The legs 206 have gripper elements at their outer ends 208 to provide a snap-fit innerlock connection to the gripper tangs 198 on the structural innerlock 186. An interior wood frame member 210 is rigidly mechanically interconnected, by way of deep-keying, to the T-shaped key section 204 of metal element 202. Thus, once the structural innerlock 186 has been fastened via vastener 190 to the panning member 162, the combination metal and wood closure piece 200 can be snap-locked in place to complete the window installation. Then, if desired, a final wood molding member 212 can be fastened to the drywall panel 160 to close off any space remaining between closure member 200 and the panel 160.

Thus, with the present invention an improved combination metal and wood window frame assembly is provided which, due to the deep-keyed interconnection of the interior wood frame members to the primary metal frame members, provides rigidity, reduced sound and noise transmission, and improved thermal properties. Further, due to the construction of the present combination wood and metal window frame assembly, this combination frame assembly can be utilized in new constructions where suitable wood stud framing members are present to position and support the window frame assembly, or the above-described continuous retainer clip means or panning member means can be utilized for retrofit type installations. It will be understood that the primary metal frame components as well as the wood frame components of the present invention preferably are relatively deeper, i.e., wider in cross-sectional dimension, than that of known prior metal and wooden frames so as to achieve the deep-keyed interconnection of the wooden frame members. Thus, all without the use of any adhesives, the wooden frame members of the present invention are integrally mechanically connected to the internal metal frame members.

From the foregoing, it is believed that those skilled in the art will readily appreciate the unique features and advantages of the present invention over previous combination metal and wood window frame designs. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

I claim:

1. A combination metal and wood window frame assembly having exterior and interior faces, comprising:

a plurality of frame members constituting the rails and stiles of the window frame assembly, each frame member including two metal frame elements, a thermal break member rigidly interconnecting said metal frame elements, and a wooden frame element extending towards the interior face of said frame assembly;

deep-key interconnection means carried respectively by said metal frame member and by said wooden frame element and cooperable with one another to provide a rigid interlock connection of said wooden frame element with said metal frame member; and a second wooden frame element which is rigidly deep-key interconnected to at least one of said metal frame elements for providing an interior wooden aesthetic covering to said metal frame member as well as for providing structural rigidity to the overall combination metal and wood window frame assembly.

2. A combination metal and wood window frame assembly having exterior and interior faces, comprising:

a plurality of frame members constituting the rails and stiles of the window frame assembly, each frame member including two metal frame elements, a thermal break member rigidly interconnecting said metal frame elements, and a wooden frame element extending towards the interior face of said frame assembly;

deep-key interconnection means carried respectively by said metal frame member and by said wooden frame element and cooperable with one another to provide a rigid interlock connection of said wooden frame element with said metal frame member; and a second wooden frame element, retainer channel means formed on at least one of the first-mentioned and second wooden frame elements for retainably securing vision strip means interposed between the wooden frame element and an associated glazing panel assembly.

3. A combination metal and wood window frame assembly having exterior and interior faces, comprising:

a plurality of frame members constituting the rails and stiles of the window frame assembly, each frame member including two metal frame elements, a thermal break member rigidly interconnecting said metal frame elements, and a wooden frame element extending towards the interior face of said frame assembly;

deep-key interconnection means carried respectively by said metal frame member and by said wooden frame element and cooperable with one another to provide a rigid interlock connection of said wooden frame element with said metal frame member; and decorative surround means adapted to be retainably secured to at least one of said metal frame elements whereby said decorative surround means provides an aesthetic molding about the periphery of the exterior of the combination metal and wood window frame assembly.

4. A combination metal and wood window frame assembly having exterior and interior faces, comprising:

a plurality of frame members constituting the rails and stiles of the window frame assembly, each frame member including two metal frame elements, a thermal break member rigidly interconnecting said metal frame elements, and a wooden frame element extending towards the interior face of said frame assembly;

deep-key interconnection means carried respectively by said metal frame member and by said wooden frame element and cooperable with one another to provide a rigid interlock connection of said wooden frame element with said metal frame member; and panning means having a first panning section operable to extend to the exterior of the combination metal and wood window frame assembly so as to cover any exterior molding adjacent a window opening, said first panning section further having first leg extension means, said panning means further having a second panning section operable to be securely interlocked to said first panning section and having second leg extension means, whereby when said first and second panning sections are securely interlocked one to another, said first and second leg extension means cooperate to securely retain the combination metal and wood window frame assembly inserted therebetween.

5. The structure of claim 4 wherein said first panning section includes two panning members and a thermal bridge member rigidly interconnecting said two panning member.

6. The structure of claim 4 including a wood frame element rigidly connected to said second panning section by deep-key retention means.

* * * * *